US008246396B2

(12) United States Patent
Lechner et al.

(10) Patent No.: US 8,246,396 B2
(45) Date of Patent: Aug. 21, 2012

(54) PROTECTIVE COVER FOR AN ELECTRICAL CONNECTOR FOR CONTACTING A CIRCUIT CARRIER

(75) Inventors: Matthias Lechner, Morlenbach (DE); Heiko Urban, Stockstadt (DE); Michael Schall, Heppenheim-Sonderbach (DE); Helge Schmidt, Speyer (DE); Michael Spielvogel, Bad Durkheim (DE); Marcus Schulte, Viernheim (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 12/605,893

(22) Filed: Oct. 26, 2009

(65) Prior Publication Data

US 2010/0144171 A1 Jun. 10, 2010

Related U.S. Application Data

(63) Continuation of application No. PCT/EP2008/003101, filed on Apr. 17, 2008.

(30) Foreign Application Priority Data

Apr. 25, 2007 (EP) ..... 07008430

(51) Int. Cl.
*H01R 13/46* (2006.01)

(52) U.S. Cl. ..... 439/892; 439/78

(58) Field of Classification Search ..... 439/83, 439/140, 381, 876, 892
See application file for complete search history.

(56) References Cited

U.S. PATENT DOCUMENTS

| | | | | |
|---|---|---|---|---|
| 4,394,795 | A * | 7/1983 | Goss | 29/739 |
| 4,645,278 | A * | 2/1987 | Yevak et al. | 439/83 |
| 4,875,870 | A * | 10/1989 | Hardy et al. | 439/204 |
| 4,941,847 | A * | 7/1990 | Welsh | 439/595 |
| 5,015,192 | A * | 5/1991 | Welsh et al. | 439/83 |
| 5,090,927 | A * | 2/1992 | McAnany | 439/892 |
| 5,522,730 | A * | 6/1996 | Soes et al. | 439/78 |
| 5,742,481 | A * | 4/1998 | Murphy et al. | 361/767 |
| 6,453,550 | B1 * | 9/2002 | Farnworth et al. | 29/842 |
| 2004/0005794 | A1 | 1/2004 | Yamashita | |
| 2005/0255725 | A1 | 11/2005 | Yamagami | |

OTHER PUBLICATIONS

PCT International Search Report cited in International Application No. PCT/EP2008/003101, dated Jul. 25, 2008, 3 pages.
PCT IPR cited in International Application No. PCT/EP2008/003101, dated Jul. 25, 2008, 1 page.
PCT Written Opinion cited in International Application No. PCT/EP2008/003101, dated Jul. 25, 2008, 5 pages.

* cited by examiner

*Primary Examiner* — Tulsidas C Patel
*Assistant Examiner* — Travis Chambers
(74) *Attorney, Agent, or Firm* — Barley Snyder

(57) ABSTRACT

A protective cover for an electrical connector for contacting a circuit carrier is disclosed, wherein the electrical connector includes an electrically insulating housing and at least one contact having a contact portion for contacting a mating contact and a connecting portion for contacting a plated through hole of the circuit carrier via an electrically conductive press-in connection. The protective cover has at least one opening through which the connecting portion of the at least one contact enters in the assembled state and is configured in such a way that, in cooperation with the contact and/or the electrically insulating housing, the protective cover covers an intake region of the plated through hole toward the outside.

24 Claims, 7 Drawing Sheets

PROTECTIVE COVER FOR AN ELECTRICAL CONNECTOR FOR CONTACTING A CIRCUIT CARRIER

CROSS-REFERENCE TO RELATED APPLICATIONS

This application is a continuation of PCT International Application No. PCT/EP2008/003101, filed Apr. 17, 2008, which claims priority under 35 U.S.C. §119 to European Patent Application No. EP07008430.6, filed Apr. 25, 2007.

FIELD OF INVENTION

The present invention relates to a an electrical connector, and more particularly, to a protective cover for an electrical connector which electrically contacts a circuit carrier, and is configured in order to avoid damage from whisker formation.

BACKGROUND

It is known that circuit carriers, for example, conventional printed circuit boards, are generally provided before the assembly thereof with printed conductor structures. The printed conductor structures, usually copper and the plated through holes, are provided with a protective layer. The protective layer is to ensure that the soldering points which are to be formed during assembly satisfy electrical and mechanical requirements. These protective layers are thus used to ensure solderability and are often called solderable end surfaces. The solderable end surfaces in current circuit carriers are generally formed from pure tin, because of the current demand for lead-free soldering.

A known drawback of tin surfaces is that they tend, to a greater or lesser extent, to form so-called "whiskers" over the course of storage. For instance, needle-shaped tin monocrystals may become a few micrometers in length and can severely impair the functioning of the circuit carrier. In this case, the whiskers may, on the one hand, cause short-circuits through bridge formation but may also, on the other hand, cause considerable damage when broken off.

The specific cause of whisker formation cannot necessarily be explained, however, it is generally believed that mechanical stresses, due to stress-induced crystallization, may cause the whisker formation. In fact, it may take a seven week storage time at room temperature, for conventional tin surfaces to form whiskers with a length of 30 μm to more than 100 μm.

The changeover required in conjunction with the European guideline "Restriction on Hazardous Substances" from tin/lead to lead-free tin layers is linked with the subject of "whisker" formation. The reason for this is that some of the favored lead-free alternatives tend to whisker formation more than tin/lead solutions do. In addition, the reduction in the printed conductor and connecting portion spacings additionally increases the risk that when whiskers are formed they eventually form an electric short-circuit between adjacent electric printed conductors which can lead to system failure.

Known solutions to these problems aim to avoid or substantially minimize the growth of whiskers for the reliable manufacturing of subassemblies for the automotive industry.

It is known, for example, that by using different types of metals in the circuit carrier and/or the connecting portions, the whisker formation can be reduced.

The drawback in these known solutions is that the circuit carrier and/or the connecting portions have to be changed with regard to their composition, and therefore demand higher costs. In addition, the addition of added metals are problematic in the production of circuit carriers for other reasons.

A problem exists in that whiskers either grow out of the contact regions in which they form, and may cause short-circuits, or else break off and may be present as undesired conductive contaminations. For example, in the case of contacts that are pressed-in, in which the connecting portion of the contact is pressed into a plated through hole of a circuit carrier, a material displacement resembling the track of a snow plough, results in an accumulation of tin in certain regions of the plated through hole.

There is therefore a need to ensure, in the electrical contacting of circuit carriers, that no functional disturbances occur through whisker formation, but without having to carry out changes to the circuit carrier processes or the actual contacts, in the process.

SUMMARY

The invention has been made in view of the above circumstances, and has an object, among others, of providing a protective cover for an electrical connector for contacting a circuit carrier. The electrical connector, for contacting a circuit carrier, includes an insulating housing, at least one contact assembled in the insulating housing, a contact portion positioned at one end of the contact for contacting a mating contact, a connecting portion at another end of the contact, a plated through hole of the circuit carrier connecting to the connection portion of the contact through an electrically conductive press-in connection, a protective cover, at least one opening in the protective cover through which the connecting portion of the at least one contact enters in an assembled state. The protective cover is configured to cooperate with the contact and/or the electrically insulating housing in order to cover an intake region of the plated through hole toward the outside.

DETAILED DESCRIPTION OF THE EMBODIMENT(S)

Figure 1:
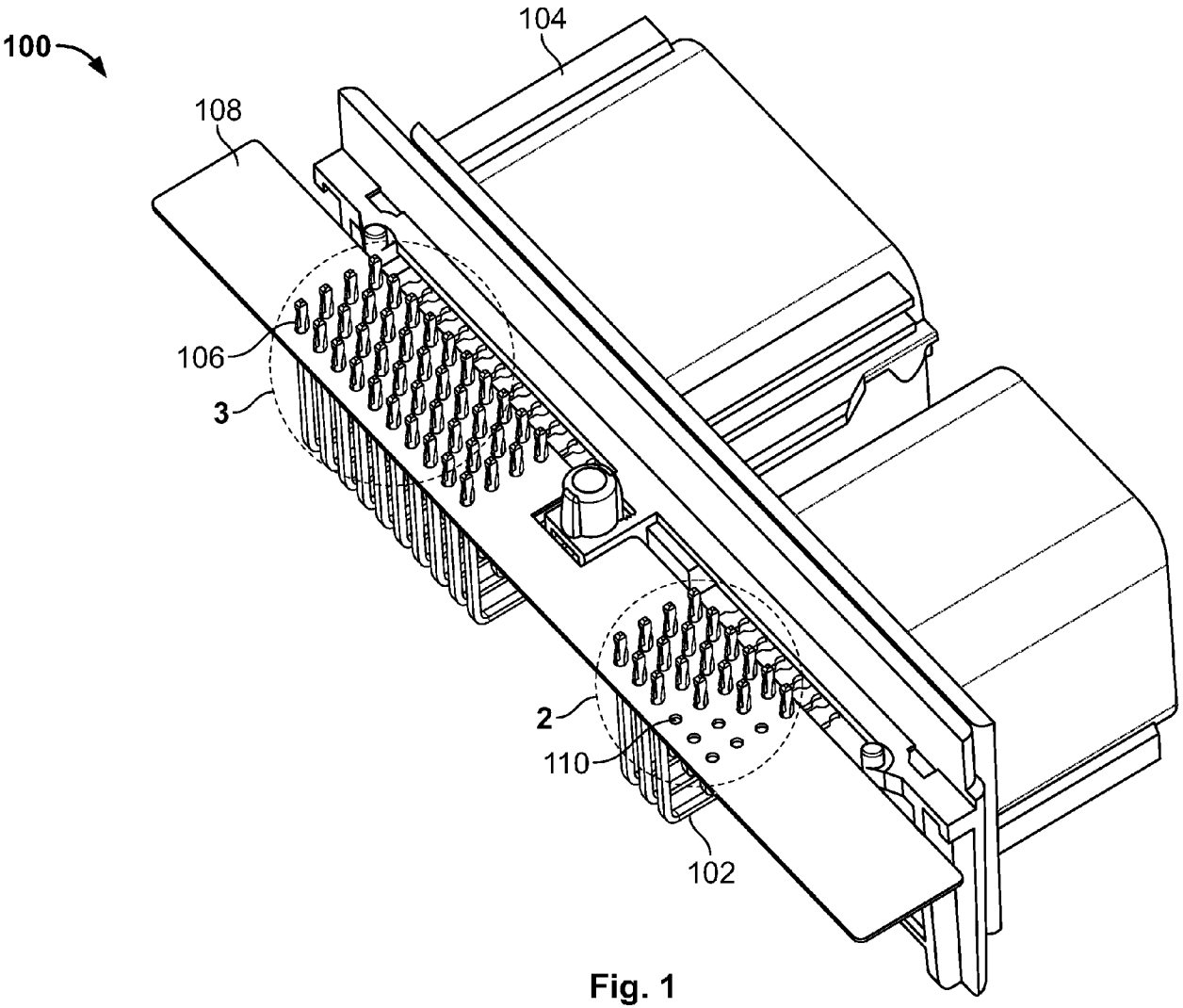
FIG. 1 shows a perspective view of an electrical connector for contacting a circuit carrier with a protective cover according to an embodiment of the present invention.

For an improved understanding of the present invention, the invention will now be described in more detail with the aid of the embodiments shown in the following figures. In this case, in the differently described embodiments, the same components will be provided with the same reference numerals and the same component designations, it being possible to accordingly transfer the disclosures contained in the entire description to the same components with the same reference numerals or component designations. Furthermore, some features or feature combinations of the shown and described different embodiments may also per se be solutions which are independent, inventive or in accordance with the invention.

With reference to FIG. 1, the basic principle of the present invention is to be described in more detail below. FIG. 1 shows a perspective view of an electrical connector 100 for contacting a circuit carrier 114 (see also FIG. 4). The connector 100 has a plurality of contacts 102, which are assembled in an electrically insulating housing 104. The contacts 102 have contact portions for contacting a mating contact (not shown) and connecting portions 106 for contacting a plated through hole 116 (FIG. 4) of the circuit carrier 114 (FIG. 4) via an electrically conductive press-in connection.

The connecting portions 106 or "pins" are configured such that when the connecting portions 106 are pressed into the plated through hole 116 (FIG. 4) of the circuit carrier 114 (FIG. 4), the connecting portions 106 may produce an electric contact. In this case, the circuit carrier 114 (FIG. 4) is generally a printed circuit board. However, other highly diverse circuit carriers in which whisker formation can occur may also be equipped with the electrical connector 100 according to the invention, for example, flexible circuit carriers or ceramic circuit carriers.

Figure 4:
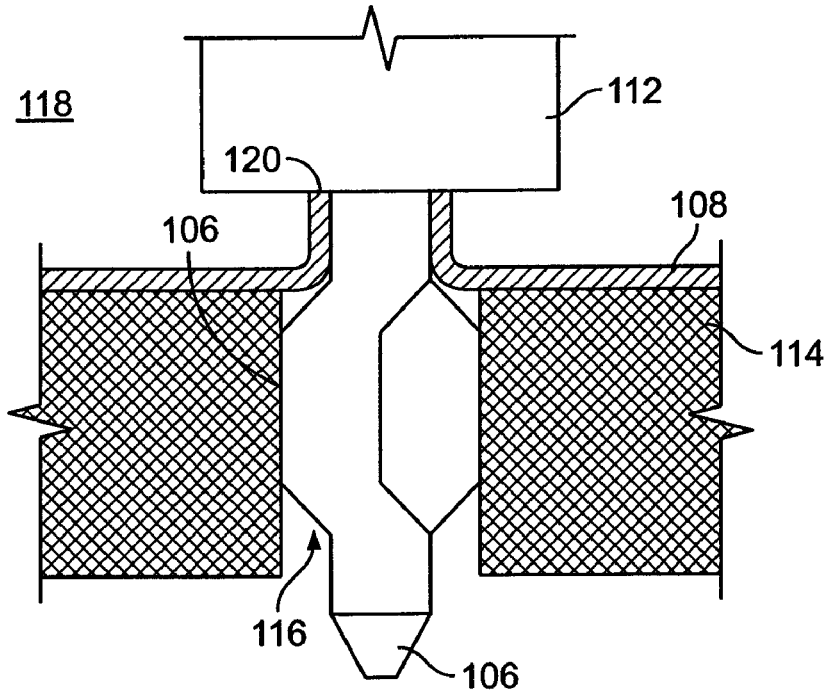
FIG. 4 shows a schematic sectional view of the electrical connector with a protective cover in an assembled state according to another embodiment of the invention.

As already described, the whiskers form on tin surfaces of a joint face between the connecting portion 106 and an inner wall of the plated through hole 116 (FIG. 4) within through-holes in the circuit carrier 114 (FIG. 4). As the whiskers grow substantially linearly, a mechanical screen, through which the contacts 102 enter, and which rests in a planar manner on the printed circuit board, can prevent functional disturbances of electronic control apparatuses, for example, a short-circuit between the contacts 102.

It is known that whiskers form especially in these regions of material accumulation under mechanical stress. If these whiskers grow out of the plated through hole 116 and reach the adjacent connecting portion 106 or if they break off and are transferred to other unfavorable locations, short-circuits and therefore serious failures may be caused. This is intolerable, in particular in conjunction with motor vehicle electronics, for example, an airbag controller, and the strict requirements occurring there with regard to long-term stability, reliability and robustness.

According to the invention, the actual physical causes of the whisker formation are not being eliminated as this is only possible by means of expensive and complex modifications to circuit carriers and/or contacts, but it is ensured that the whiskers which may possibly form cannot leave the region of the press-in connection.

According to the invention, the connector 100 therefore includes a protective cover 108, which for each of the contacts 102 has an opening 110, through which the connecting portion 106 enters. The protective cover 108 is configured in such a way that, in cooperation with the contacts 102 and/or the electrically insulating housing 104, the protective cover 108 covers an intake region of the plated through holes 116 (FIG. 4) toward the outside.

It can be shown that, although the whiskers continue to be formed with a protective cover 108, their growth is hindered by the protective cover 108 (they continue to grow in a bent form under the protective cover 108) and they cannot spread out of the region in or on the through-hole of the circuit carrier 114, nor can they produce short-circuits or other failures.

The electrical connector 100, shown in FIG. 1, may be kept ready with the assembled protective cover 108 and during assembly may be pressed onto the circuit carrier 114 (FIG. 4), which will be explained later with reference to FIGS. 4 to 6.

The openings 110 are prefabricated in the embodiment shown, but, as an alternative, may also be configured by directly pressing the protective cover 108 onto the connecting portions 106 during assembly of the electrical connector 100.

Figure 2:
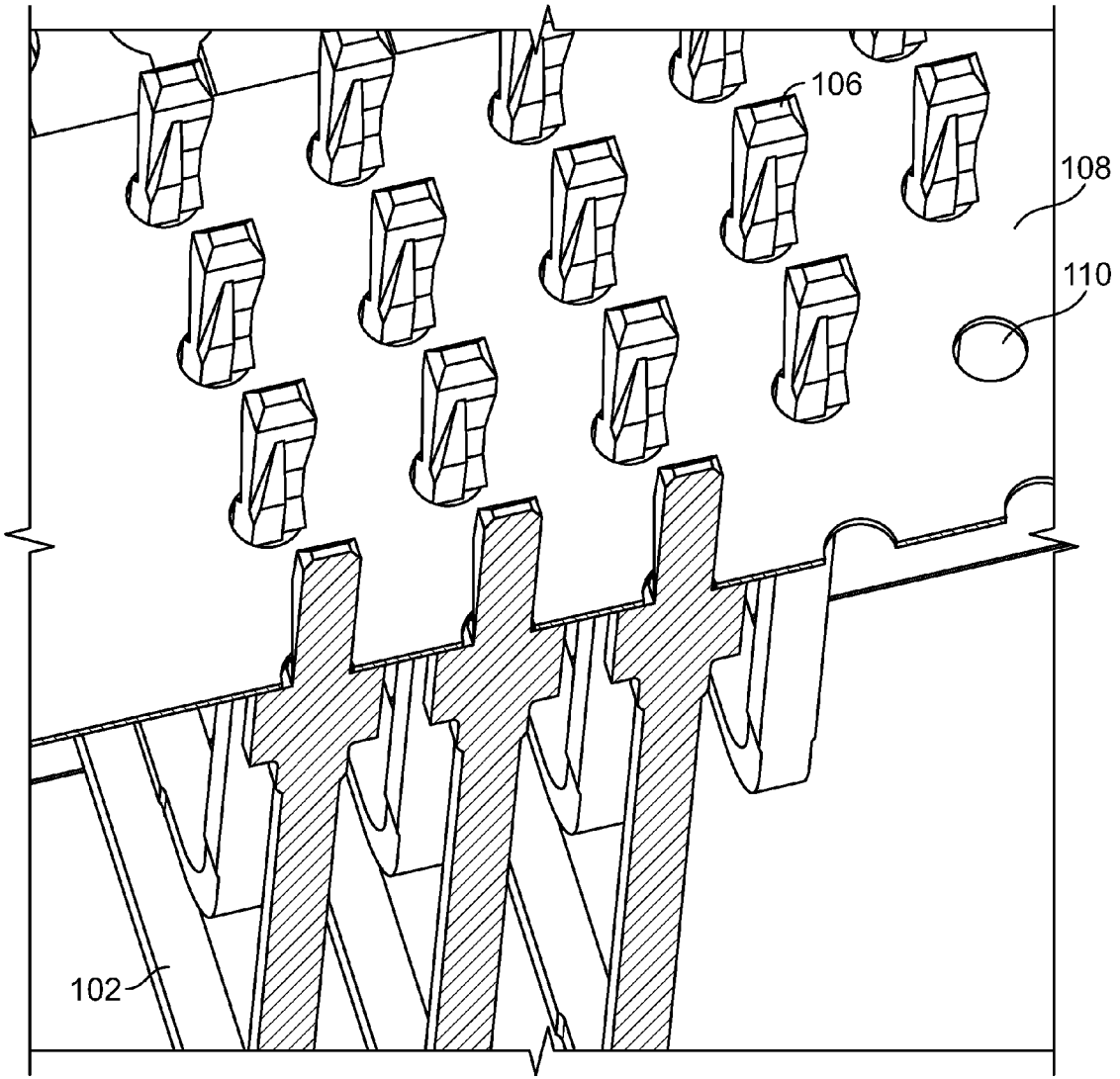
FIG. 2 shows a perspective exploded view of detail 2 from FIG. 1 showing connecting portions assembled with the protective cover.

As shown in FIG. 2, the connecting portions 106 enter through the openings 110 of the protective cover 108 in such a way that an end region of the connecting portions 106 is screened relative to an outer region 118, which is located below the protective cover 108 in FIG. 2. In the embodiment shown here, the protective cover 108 is formed by a flat perforated plastic material plate. A surface of the protective cover 108, which faces upward in FIG. 2, comes into contact with a surface of the printed circuit board during assembly and closes the through-holes, into which the connecting portions 106 are pressed, in a flush manner, so that whiskers, which may possibly form, cannot penetrate into the region located on the other side of the protective cover 108 and, in particular, cannot cause any short-circuits between the contacts 102.

Figure 3:
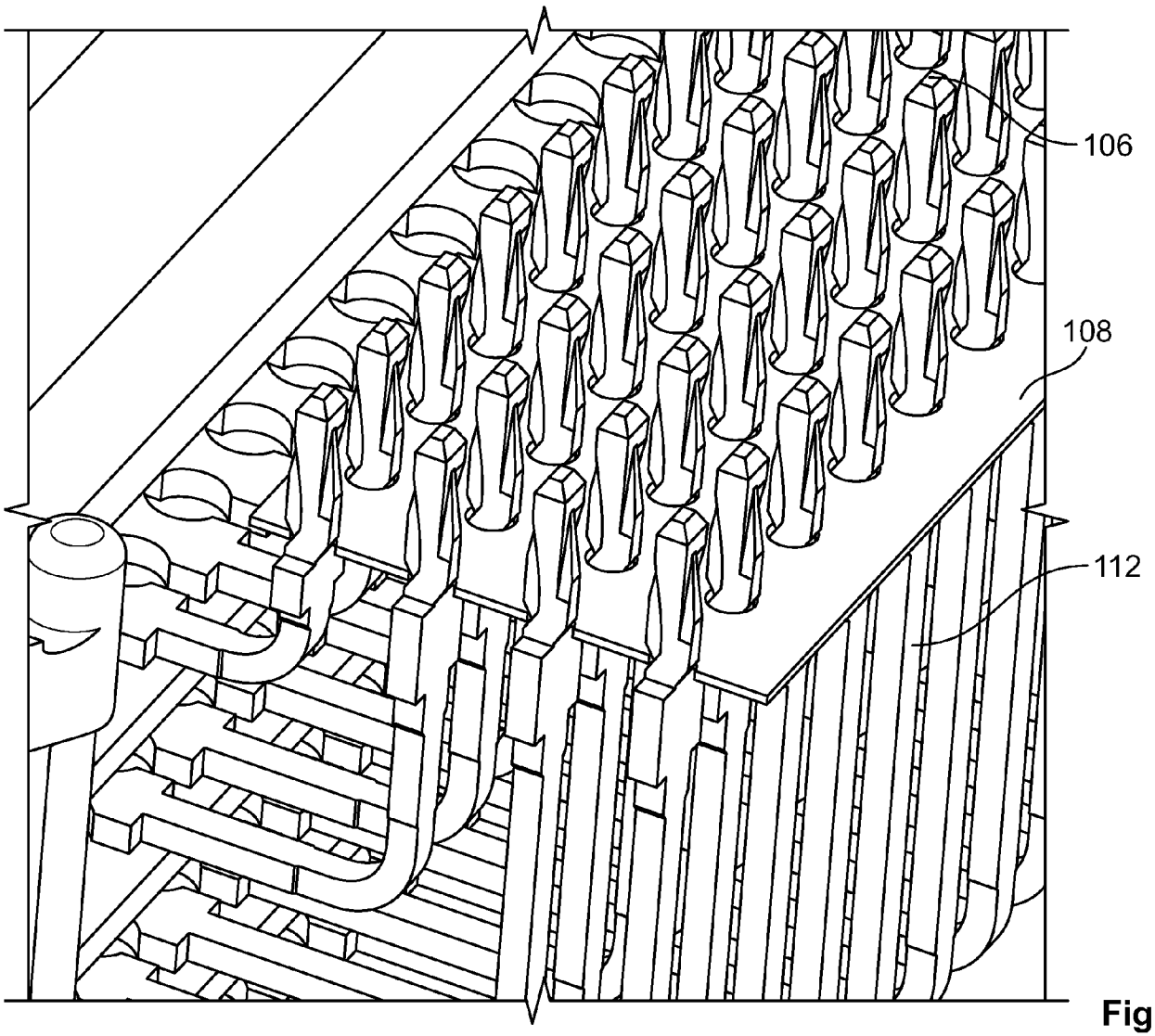
FIG. 3 shows a perspective exploded view of detail 3 from FIG. 1 showing the connecting portions assembled with the protective cover.

FIG. 3 shows a detail 3 from FIG. 1 in an enlarged and partially sectional view. As shown in FIG. 1, extensions 112 of the connecting portions 106, in particular, are surrounded in a particularly flush manner by the protective cover 108 to prevent a growth of whiskers forming preferentially at this location to the outside.

Figure 5:
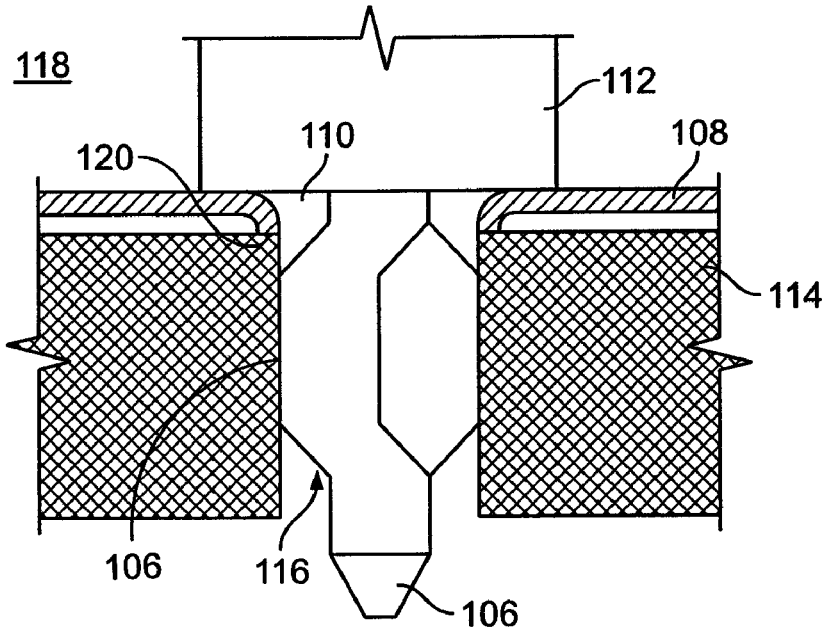
FIG. 5 shows a schematic sectional view of the electrical connector with a protective cover in an assembled state according to another embodiment of the invention.
Figure 6:
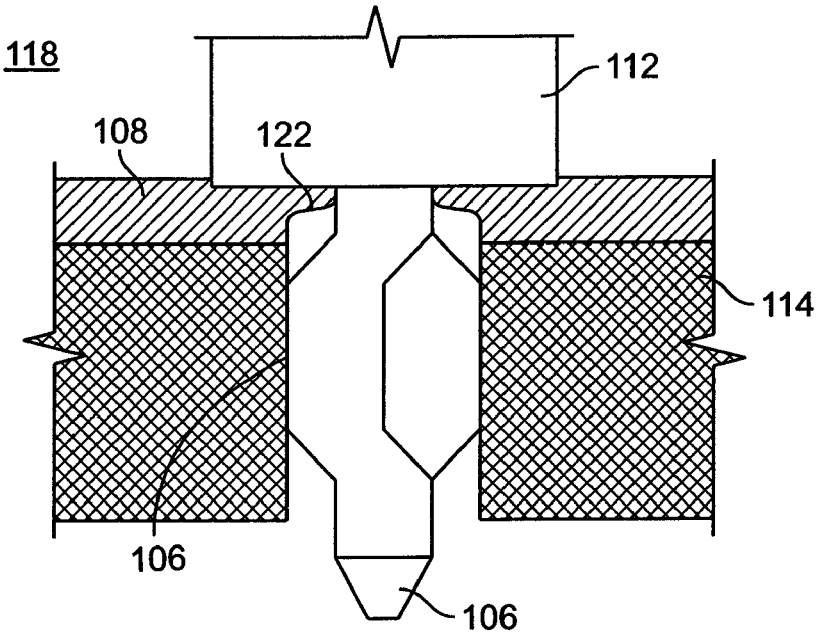
FIG. 6 shows a schematic sectional view of the electrical connector with a protective cover in an assemble state according another embodiment of the invention.

FIGS. 4 to 6 show other embodiments of the electrical connector 100 after assembly in circuit carrier 114. These views are turned 180° relative to those of FIGS. 1 to 3, i.e. the connecting portions 106 are shown directed downward here.

The actual whisker formation, as already mentioned, takes place on the extensions 112 inside the plated through hole 116 of the circuit carrier 114. According to the invention, the protective cover 108 closes the extensions 112 relative to an outer region 118 remote from the circuit carrier 114.

Various configurations of the protective cover 108 are shown in detail in FIGS. 4 to 6, the embodiment shown having a more complex geometric configuration than the protective cover 108 of FIGS. 1 to 3.

Thus, the protective cover 108 of FIG. 4 has a step 120, which is formed by a one-sided indentation and supports the protective cover 108 opposite the insulating housing 104. At the same time, an edge of the opening 110 of the protective cover 108 surrounds the connecting portion 106 in a flush manner so the protective cover 108 in cooperation with the electrically insulating housing 104 and the connecting portion 106 covers the intake region of the plated through hole 116, in which the extensions 112 are located, from the outer region 118. This prevents whiskers or other particles from being able to spread from the region in or on the plated through hole 116 and, for example, being able to produce short-circuits.

If the protective cover 108 of FIG. 4 is turned around and larger openings 110 are used, the protective function according to the invention can also be achieved in that the covering of the extensions 112 from the outer region 118 is only implemented by the cooperation between the housing 104 and the protective cover 108. This has the advantage that a secure sealing and protective function can be achieved even without having to ensure peripheral mechanical contact between the contacts 102 and the protective cover 108. However, this variant assumes that the connecting portions 106 are held in the plated through hole 116 so firmly that no play can occur between the protective cover 108 and the electrically insulating housing 104.

A combined variant, in which the protective cover 108 cooperates both with the contacts 102 and with the electrically insulating housing 104 to seal the extensions 112 from the outer region 118, is shown in FIG. 6. The protective cover 108, according to this embodiment, has a sealing lip 122, which is formed, for example, by a region with a reduced material thickness which directly surrounds the contact 102. The protective cover 108 for this embodiment is as far as possible formed by a resilient material, such as, for example, silicone or a thermoplastic elastomer, as the sealing function of the sealing lip 122 can be ensured most easily in this manner.

Figure 7:
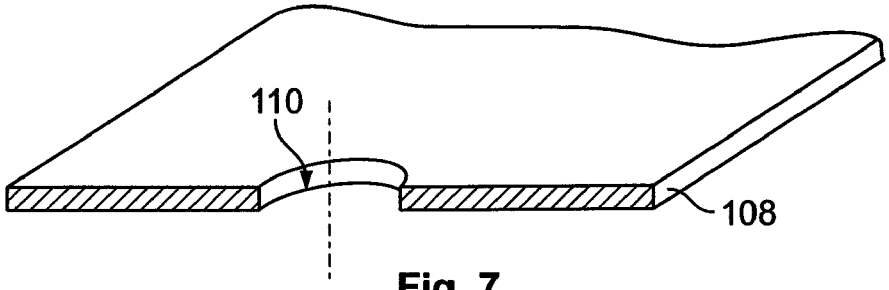
FIG. 7 shows a schematic sectional view of the protective cover according to the embodiment shown in FIG. 1.

FIGS. 7 to 11 show various possible configurations of the protective cover 108. Thus, the protective cover 108, as shown in FIG. 7, may consist of a flat plastic material plate or film, into which the openings 110 are introduced as perforations. This corresponds to the protective cover 108 shown in FIGS. 1 through 3.

Figure 8:
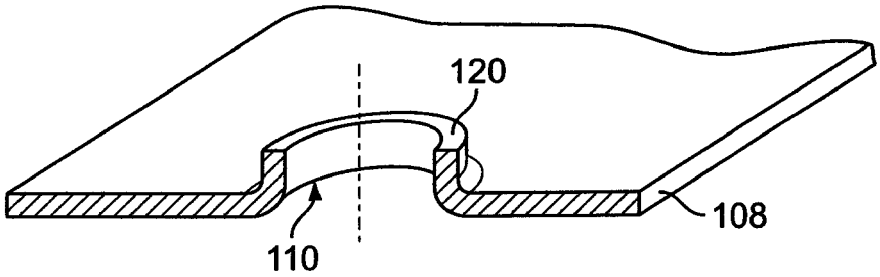
FIG. 8 shows a schematic sectional view of the protective cover according to the embodiment shown in FIGS. 4 and 5.

Furthermore, the step 120 can be implemented by a one-sided indentation, as shown in FIG. 8. Step-like edge regions of this type of the openings 110 can, depending on their size in relation to the dimensions of the plated through hole 116 and the connecting portions 106, either be assembled as in FIG. 4 or be inserted according to FIG. 5.

Figure 9:
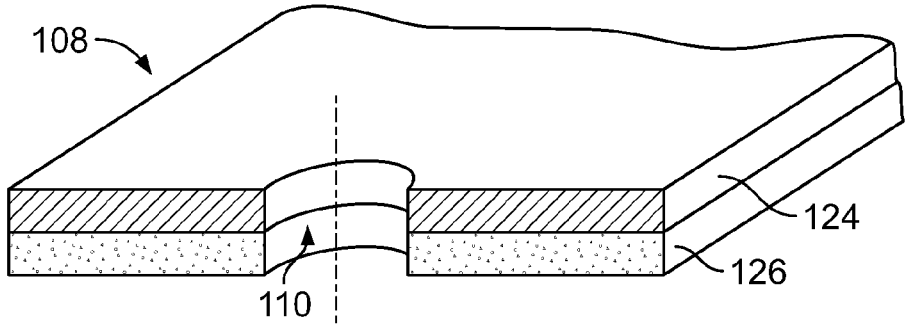
FIG. 9 shows a schematic sectional view of a double layer protective cover.

FIG. 9 shows an embodiment in which a supplemental layer 126 extends from a rigid carrier layer 124 forming the protective cover 108. The supplemental layer 126, for example, may be a gel pad, foam material, or an adhesive. The resilience of a supplemental layer 126, prepared from a gel pad, allows tolerances to be compensated within certain limits, so no undesired openings remain through which the whiskers could grow. To ensure that whiskers and other loose or easily adhering particles are firmly bound, one or more surfaces of the protective cover 108 may be adhesively coated or consist, in individual layers, of adhesively coated strips or films. A self-adhesive film, as a supplemental layer 126, of this type may optionally also be applied in advance to the circuit carrier 114.

Figure 10:
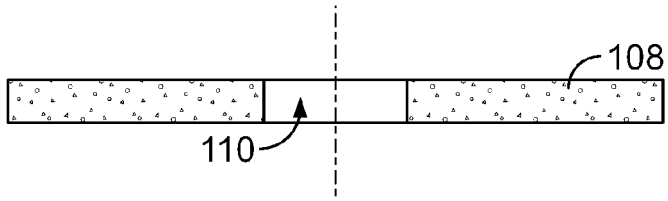
FIG. 10 shows a schematic sectional view of a single layer protective cover.

As an alternative, as shown in FIG. 10, the entire protective cover 108 may be produced from a gel or a foamed material.

Figure 11:
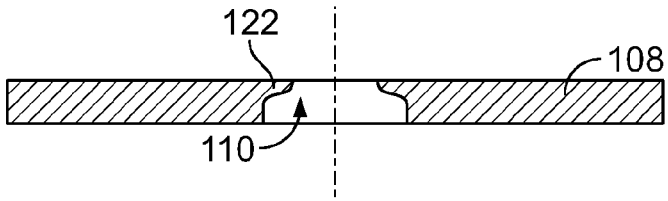
FIG. 11 shows a schematic sectional view of the protective cover according to the embodiment shown in FIG. 6.

FIG. 11 schematically shows the protective cover 108 corresponding to the embodiment of FIG. 6, in which the sealing lip 122 is formed, for example, of a silicone material.

Figure 12:
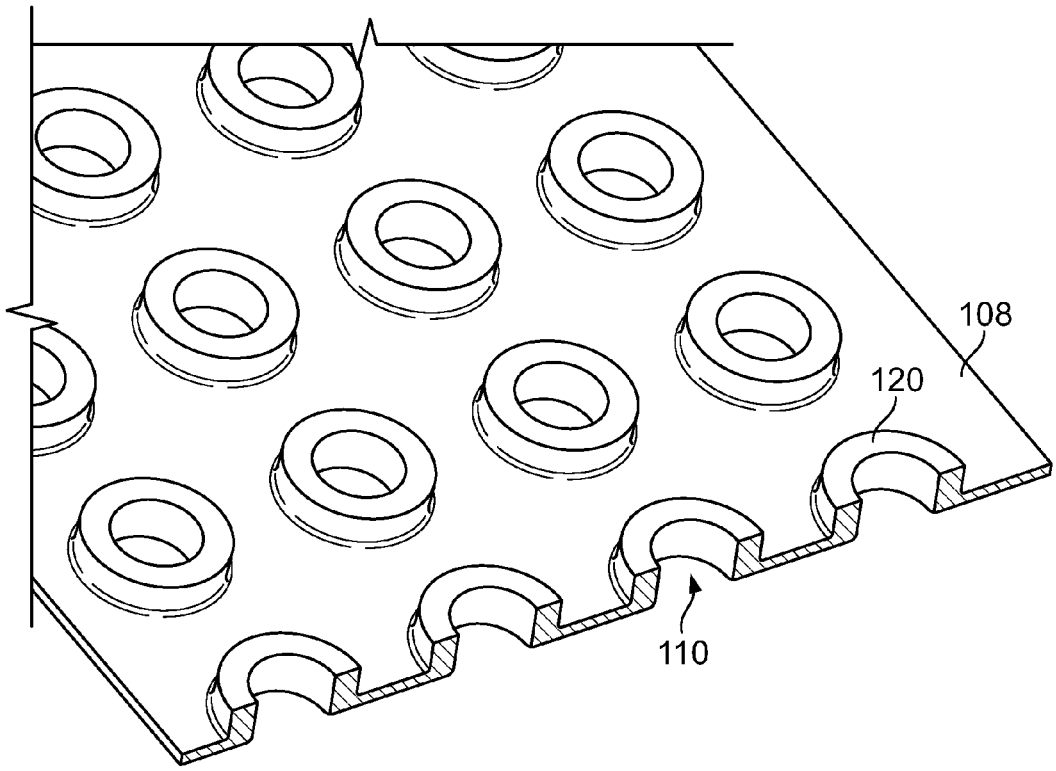
FIG. 12 shows a schematic view of the protective cover according to the embodiment shown in FIGS. 5 and 6, and having a plurality of openings.
Figure 13:
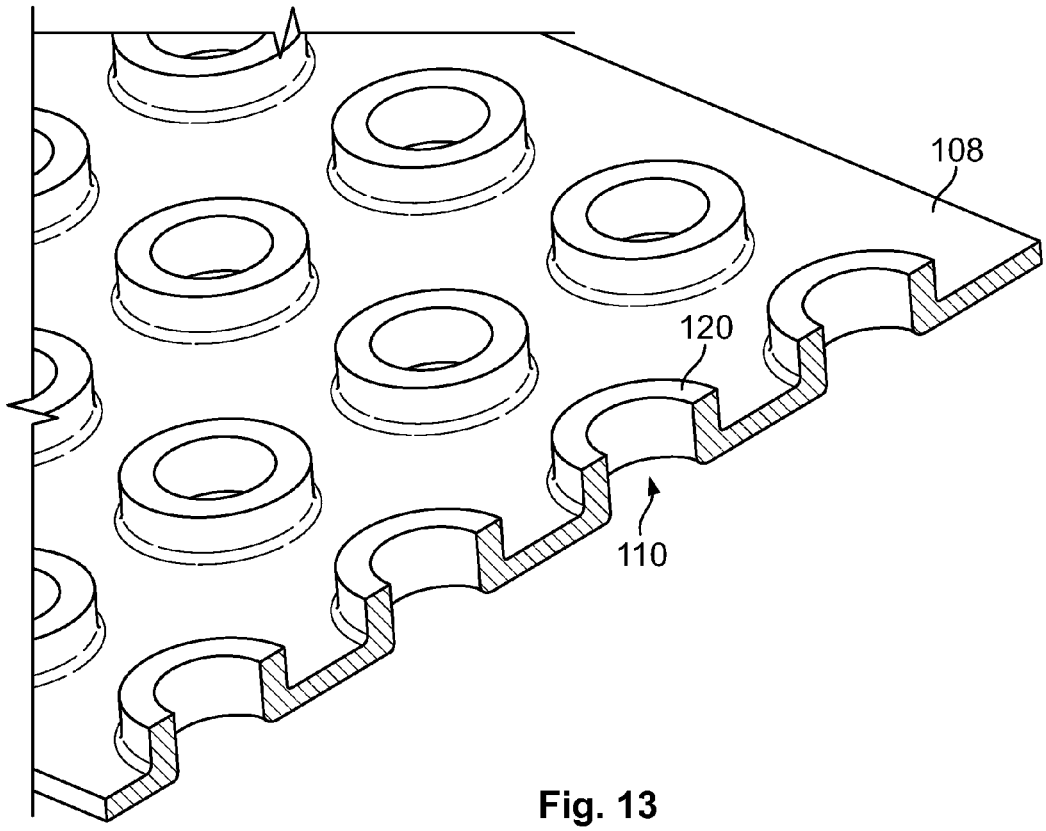
FIG. 13 shows a tilted enlarged schematic view of the protective cover from FIG. 12.

FIG. 12 shows the protective cover 108, analogous to the variant from FIG. 8, for a plurality of the plated through holes 116 and the connecting portions 106 corresponding to the embodiment of FIGS. 1 and 3. The protective cover 108 of this type is produced as one piece. As a result, the whisker protective function can be implemented for a plurality of press-in connecting portions 106 in one working step. FIG. 13 shows the view of FIG. 12, turned and enlarged.

Figure 14:
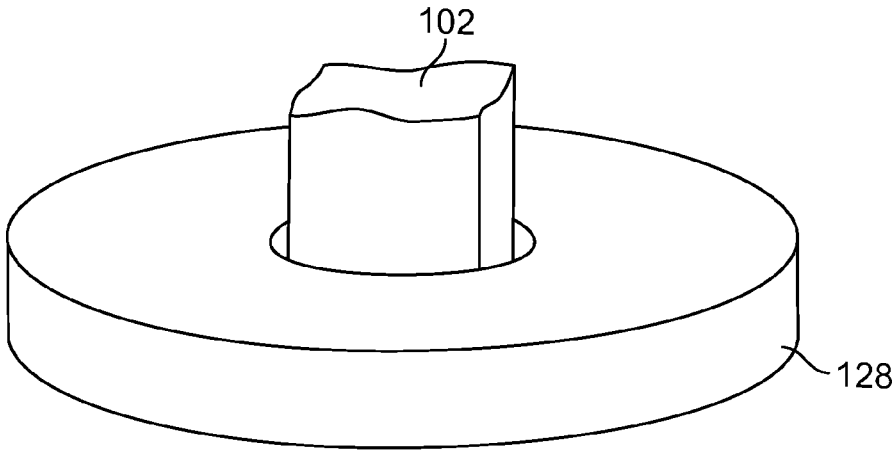
FIG. 14 shows a perspective view of the protective cover configured as a partial cover.

However, the variant in which the protective cover 108 is produced in one piece for a plurality of the contacts 102 requires a comparatively flat circuit carrier surface. In particular, no differences in level should occur between upper sides of the individual plated through holes 116. In order to reliably contact different levels, or even also to achieve increased flexibility in the production of the protective covers 108 of this type for a smaller number of the contacts 102, a separate partial cover 128 may also be provided, as an alternative, for each of the contacts 102 or a smaller group of the contacts 102. This scenario is shown schematically in FIG. 14.

The existing so-called Sn-Flash surface can thus be used at the contacts 102 despite a technologically induced whisker formation, as the whiskers cannot have any function-impairing influence on the surroundings, because of the protective cover 108. Alternatively, whisker-free surfaces, not based on tin, which have an unacceptable press-in and press-out behavior, do not have to be used. The present invention is therefore suitable, above all, for airbag control apparatuses, which have to have a high degree of reliability and an optimal electric contact.

In summary, with the aid of the protective cover 108 according to the invention for an electrical connector 100 for contacting the circuit carrier 114, any functional disturbance at electronic control apparatuses through whisker formation in the contacts 102 on electroplated pure tin surfaces can be prevented. For this purpose, neither the materials of the circuit carrier 114 nor the surfaces of the connecting portions 106 of the contacts 102 have to be modified, and the required guidelines for environmentally friendly product design can be adhered to, as well as the stringent requirements for reliability and security against failure of connections of this type in the motor vehicle sector.

While the embodiments of the present invention have been illustrated in detail, it should be apparent that modifications and adaptations to those embodiments may occur.

The invention claimed is:

1. An electrical connector for contacting a circuit carrier, comprising:
- an insulating housing;
- at least one contact assembled in the insulating housing;
- a contact portion positioned at one end of the contact for contacting a mating contact;
- a connecting portion at another end of the contact;
- a plated through hole of the circuit carrier connecting to the connection portion of the contact through an electrically conductive press-in connection;
- a protective cover;
- at least one opening in the protective cover through which the connecting portion of the at least one contact enters in an assembled state;
- wherein the protective cover has a surface feature and is configured to cooperate with the contact and/or the insulating housing so the protective cover covers an intake region of the plated through hole toward the outside and the surface feature abuts a front face of a wide portion of an extension adjacent the connecting portion.

2. The electrical connector according to claim 1, wherein the protective cover is formed by a substantially flat plate.

3. The electrical connector according to claim 1, wherein the at least one opening is formed by a hole, the edge of which rests peripherally on the contact, in the contacted state.

4. The electrical connector according to claim 1, wherein the surface feature is a step in a region of the opening through which the at least one contact enters in the assembled state, the step supports the protective cover against the electrically insulating housing.

5. The electrical connector according to claim 1, wherein the surface feature is a sealing lip configured as a region of reduced thickness around at least one opening.

6. The electrical connector according to claim 1, wherein the surface feature is at least one gel layer of the protective cover.

7. The electrical connector according to claim 1, wherein the surface feature is at least one foamed material layer of the protective cover.

8. The electrical connector according to claim 1, wherein the surface feature is at least one adhesion layer of the protective cover.

9. The electrical connector according to claim 1, wherein the protective cover is configured in one piece for a plurality of plated through holes and a plurality of associated connecting portions.

10. The electrical connector according to claim 1, wherein a wide portion of an extension adjacent the connecting portion engages the protective cover.

11. The electrical connector according to claim 1, wherein the protective cover is produced from a resilient material.

12. The electrical connector according to claim 11, wherein the resilient material is produced from a thermoplastic elastomer or silicone.

13. The electrical connector according to claim 1, wherein the protective cover is formed by a plurality of separate partial covers for a plurality of plated through holes and a plurality of associated connecting portions.

14. The electrical connector according to claim 13, wherein the partial covers have an annular configuration.

15. A protective cover for an electrical connector for contacting a circuit carrier, wherein comprising:

at least one opening in the protective cover through which a connecting portion of the at least one contact enters in an assembled state;

wherein the protective cover has a surface feature and is configured to cooperate with the contact and/or a electrically insulating housing so the protective cover covers an intake region of a plated through hole of the circuit carrier toward the outside and the surface feature abuts a front face of a wide portion of an extension adjacent the connecting portion.

16. The protective cover according to claim 15, wherein the at least one opening is formed by a hole, the edge of which rests peripherally on the contact, in the contacted state.

17. The protective cover according to claim 15, wherein the surface feature is a step in a region of the opening through which the at least one contact enters in the assembled state, the step supports the protective cover against the electrically insulating housing.

18. The protective cover according to claim 15, wherein the protective cover is produced from a resilient material.

19. The protective cover according to claim 15, wherein the surface feature is a sealing lip configured as a region of reduced thickness around at least one opening.

20. The protective cover according to claim 15, wherein the surface feature is at least one gel layer of the protective cover.

21. The protective cover according to claim 15, wherein the surface feature is at least one foamed material layer of the protective cover.

22. The protective cover according to claim 15, wherein the surface feature is at least one adhesion layer of the protective cover.

23. The protective cover according to claim 15, wherein the protective cover is configured in one piece for a plurality of plated through holes and a plurality of associated connecting portions.

24. The protective cover according to claim 15, further comprising a plurality of separate partial covers that form the protective cover, the separate partial covers formed for each plated through hole and associated connecting portion.

* * * * *